US011311108B2

(12) United States Patent
Marjadsingh

(10) Patent No.: US 11,311,108 B2
(45) Date of Patent: Apr. 26, 2022

(54) TRANSFORMABLE FURNITURE

(71) Applicant: Keith Marjadsingh, Woodbridge (CA)

(72) Inventor: Keith Marjadsingh, Woodbridge (CA)

( * ) Notice: Subject to any disclaimer, the term of this patent is extended or adjusted under 35 U.S.C. 154(b) by 0 days.

(21) Appl. No.: 16/988,193

(22) Filed: Aug. 7, 2020

(65) Prior Publication Data

US 2021/0037983 A1 Feb. 11, 2021

(30) Foreign Application Priority Data

Aug. 7, 2019 (CA) ..... CA 3051250

(51) Int. Cl.

| | |
|---|---|
| ***A47C 17/62*** | (2006.01) |
| ***A47C 17/165*** | (2006.01) |
| ***A47C 17/38*** | (2006.01) |
| ***A47C 19/22*** | (2006.01) |

(52) U.S. Cl.

CPC ..... *A47C 17/62* (2013.01); *A47C 17/165* (2013.01); *A47C 17/38* (2013.01); *A47C 19/22* (2013.01)

(58) Field of Classification Search

CPC ..... A47C 17/62; A47C 17/165; A47C 17/38; A47C 19/22; A47C 19/20

See application file for complete search history.

(56) References Cited

U.S. PATENT DOCUMENTS

| | | | | |
|---|---|---|---|---|
| 6,779,208 | B2 * | 8/2004 | Lim | A47C 17/20 5/136 |
| 2016/0242556 | A1 * | 8/2016 | Ray | A47B 83/00 |

* cited by examiner

*Primary Examiner* — Fredrick C Conley

(74) *Attorney, Agent, or Firm* — Craft Chu PLLC; Andrew W. Chu

(57) ABSTRACT

A transformable piece of furniture transforms between a bed, a sofa and a desk. The furniture includes a bed frame pivotally mounted between a pair of frame members and movable between a horizontal bed orientation and a vertical orientation. A seat member is pivotally mounted to a desk member below the bed frame such that the seat member is exposed when the bed frame is vertically oriented. The desk member can be raised to desk height by raising it and flipping the seat member into a vertical orientation.

4 Claims, 6 Drawing Sheets

TRANSFORMABLE FURNITURE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention relates generally to furniture which can be transformed from a bed to a sofa to a desk.

2. Description of Related Art Including Information Disclosed Under 37 CFR 1.97 and 37 CFR 1.98

Transformable beds which can be elevated to make room for additional living space are well known in the art. These beds, often called Murphy Beds, generally consist of a base member with a bedframe pivotally mounted thereto. The bedframe can be pivoted between a lowered position wherein the bed is horizontal and parallel to the floor, and an elevated position wherein the bedframe is vertically oriented and perpendicular to the floor. In its lowered position, a user can use the bed much like any standard bed. When the bed is not in use, it can be placed into its elevated position which allows the bed to occupy less space.

Other design approaches have been taken to create a bed which transforms into a sofa. For example, the mattress frame can be made to fold such that the bed can transform into a sofa. Bed/sofa transformable furniture has been available for some time as a result of various designs. However, to date there have been few attempts at a transformable bed which can transform between three separate orientations to form a single piece of furniture which can fulfill more than two separate roles.

BRIEF SUMMARY OF THE INVENTION

In accordance with one aspect of the present invention, there is provided a piece of furniture which can transform between a bed, a sofa seat and a work desk. The furniture includes a housing having right and left frame members coupled together by at least one transverse member. A bed frame is positioned between and pivotally coupled to the frame members and the bed frame is pivotally movable between a horizontal orientation and a vertical orientation. Right and left elongated arms are pivotally coupled to the right and right and left frame members and a desk member is coupled to the arms. The desk member extends between the frame members, the desk member having opposite first and second ends pivotally coupled to the left and right elongated arms, respectively. A seat member is pivotally connected to the desk member and positioned between the desk member and the bed frame with the seat member extending between the frame members. The seat member has opposite first and second ends pivotally connected to the first and second ends of the desk member, respectively. The desk member and the seat member are movable between a seat orientation and a desk orientation when the bed frame is in its vertical orientation, the seat member being horizontally oriented with the desk member positioned below the seat member when in the seat orientation, the desk member being elevated with the seat member being vertically oriented when in the desk orientation.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

BRIEF DESCRIPTION OF THE SEVERAL VIEWS OF THE DRAWINGS

In the drawings like characters of reference indicate corresponding parts in the different figures.

DETAILED DESCRIPTION OF THE INVENTION

Figure 1:
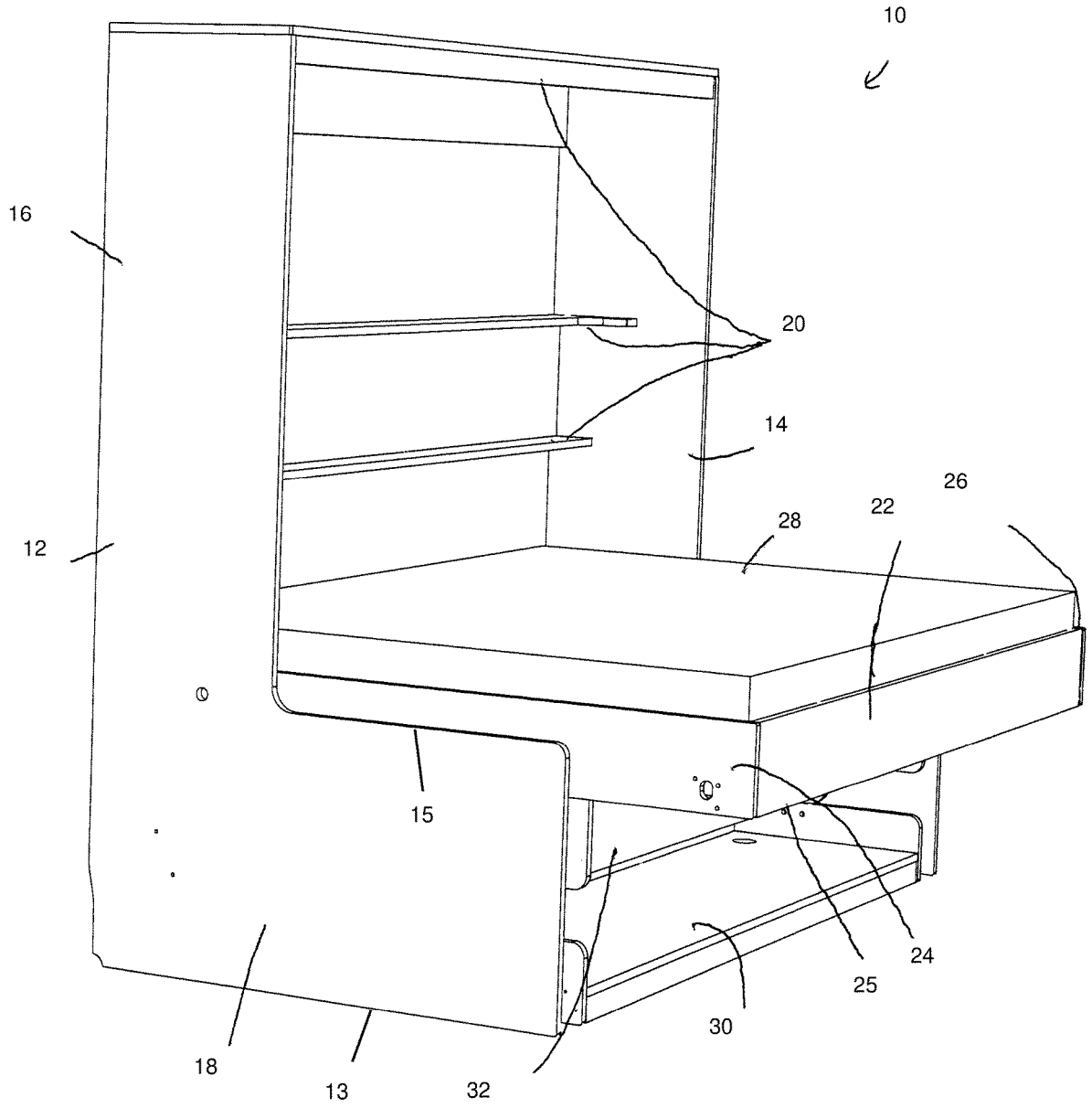
FIG. 1 is a perspective view of a transforming piece of furniture made in accordance with the present invention showing the furniture in its bed configuration.

Referring to FIG. 1, a convertible bed (furniture) made in accordance with the present invention is shown generally as item 10 and consists of a pair of left and right frame members 12 and 14. It will be appreciated that transformable bed 10 has bilateral symmetry so that the left and right sides are identical with identical components. For the purposes of this disclosure, only one side, the left side, will be discussed in detail, but it is to be understood that every component and feature found on the left side has it's mirror image on the right side. Frame member 12 is preferably L-shaped having upper portion 16 and lower portion 18 (a right L-shaped member 12 having an upper right portion 16 and a lower right portion 18, the lower right portion being set at a right angle to the upper right portion and having a bottom right edge 13 and a top right edge 15; a left L-shaped member 14 having an upper left portion 17 and a lower left portion 19, the lower left portion being set at a right angle to the upper left portion and having a bottom left edge 21 and a top left edge 23). Transverse members 20 are mounted to frame members 12 and 14 so as to keep the two frame members rigidly parallel to each other. Bedframe 22 is positioned between frame members 12 and 14. The bed frame has opposite ends 24 and 26 which are pivotally coupled to frame members 12 and 14, respectively.

Figure 2:
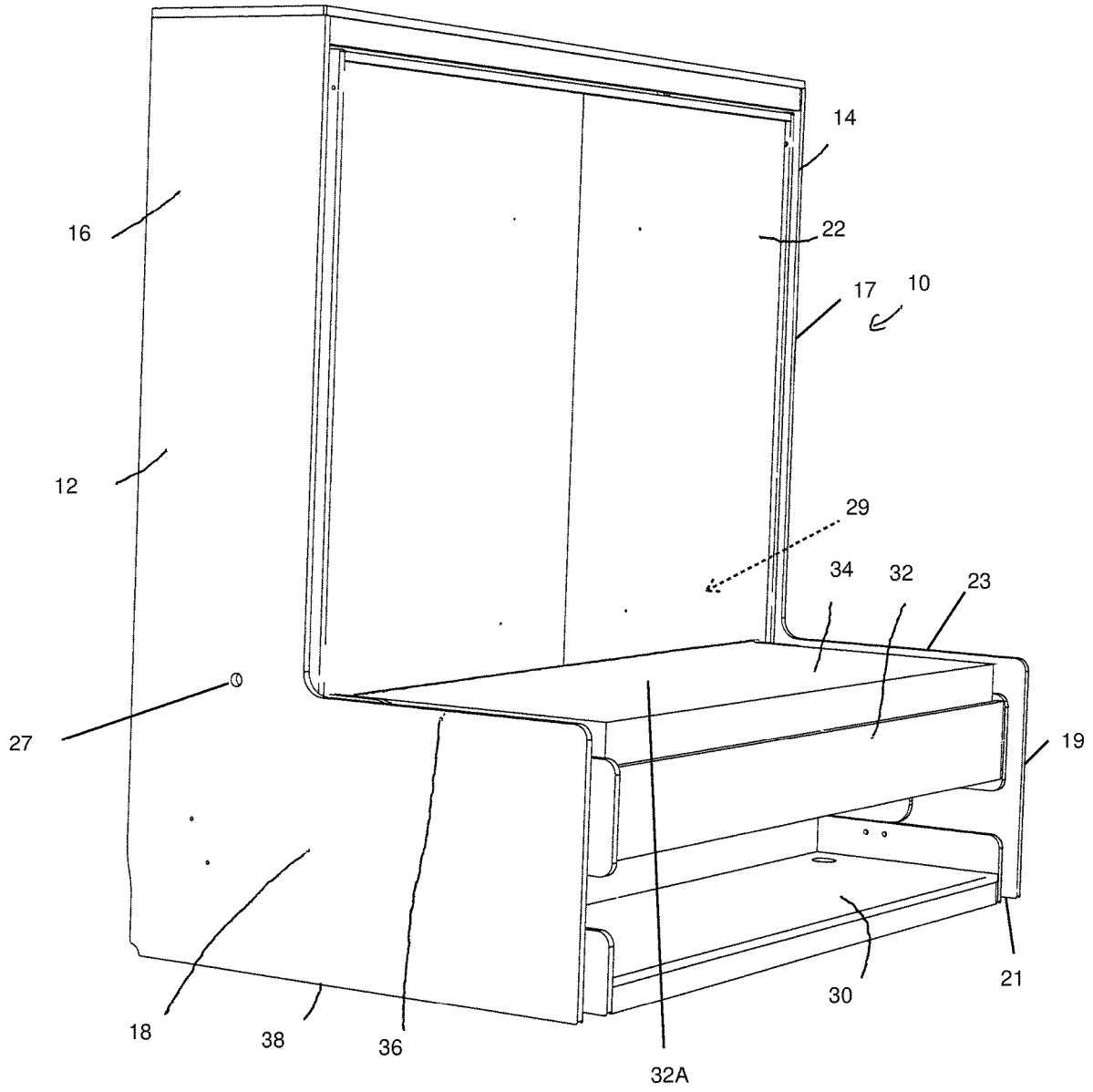
FIG. 2 is a perspective view of the furniture shown in FIG. 1 in its sofa configuration.

Bed frame 22 is dimensioned and configured to receive bed mattress 28. Desk member 30 is movably mounted to frame members 12 and 14 below bed frame 22. Seat member 32 is pivotally mounted to desk member 30 and is positioned between the desk member and bed frame 22. Bed frame 22 can pivot between a horizontal orientation as shown in FIG. 1 and a vertical orientation as shown in FIG. 2. When the bed frame is in its horizontal orientation, bed 10 can be used as a standard bed with the user being able to recline onto the horizontally positioned mattress. Additional support legs may be provided at end 25 of the bed frame to provide additional support to the bed frame when someone rests on the mattress.

Referring now to FIG. 2, when bed frame 22 is in its vertical orientation, the bed frame will be nestled within upper portions 16 of frame members 12 and 14 and seat member 32 will be exposed. Seat member 32 can take the form of a frame which is configured to receive seat cushion 34. In the orientation shown in FIG. 2, seat member 32 can act as a seat allowing users to use convertible furniture 10 as a sofa. Seat member 32 will have a flat surface (flat seat surface 32A having flat seat surface 32A, first seat edge 32B, second seat edge 32C, top seat side 32D, and bottom seat side 32E) upon which the user can sit on, which in the example illustrated in FIG. 2, is covered by seat cushion 34. Seat member 32 is positioned adjacent top edge 36 of bottom portion 18 of frame members 12 and 14 so that the seat member is nested within and between the frame members. Bed frame 22 acts as a back rest permitting the furniture to appear and act very much like a sofa. Desk member 30 is kept in its lower position adjacent lower edge 38 of frame members 12 and 14.

Figure 3:
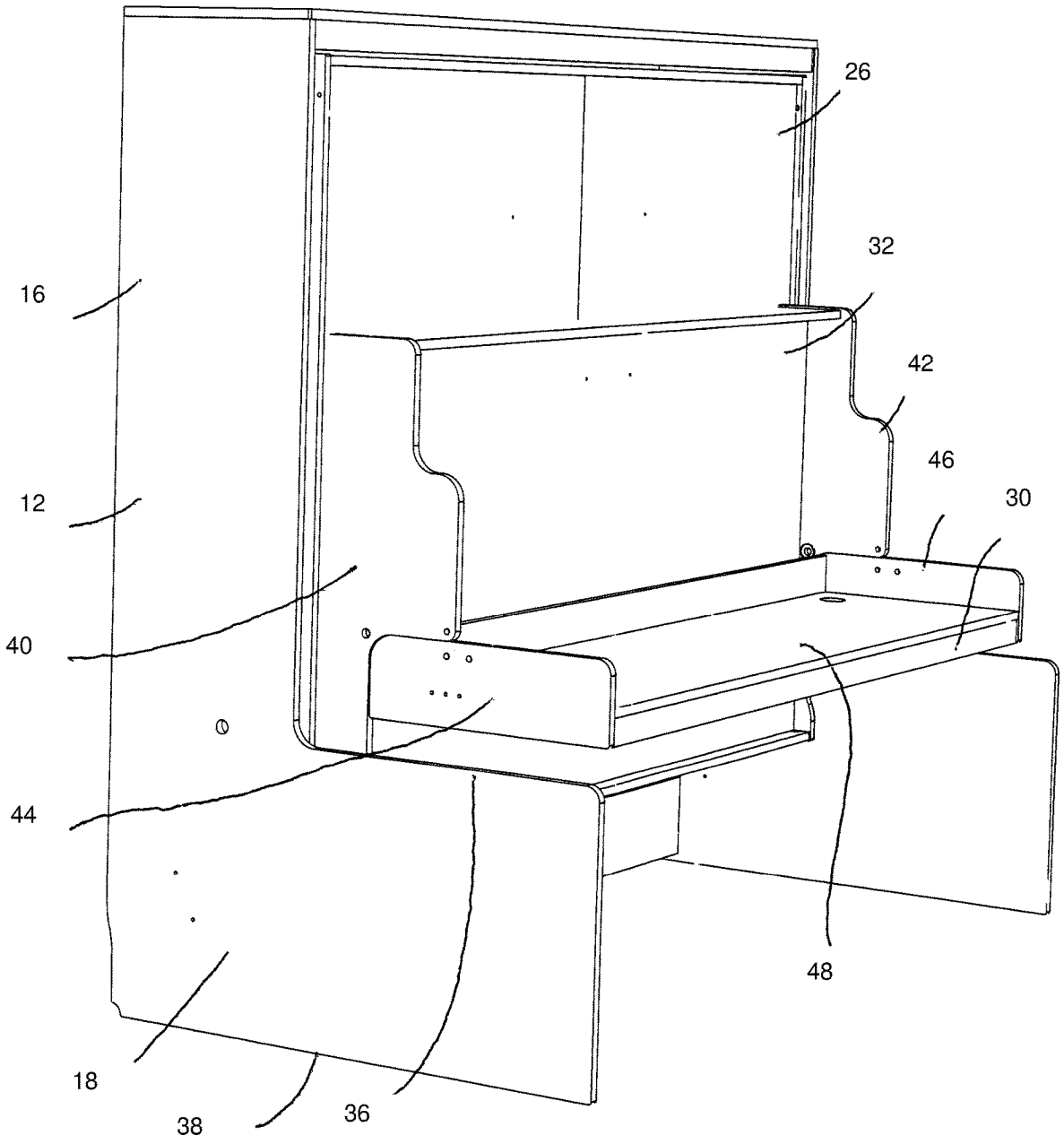
FIG. 3 is a perspective view of the furniture shown in FIG. 1 in its desk configuration.

Referring now to FIG. 3, desk member 30 can be placed in a raised position as shown in FIG. 3. In order to position desk member 30 into its raised position, seat member 32 must be pivoted into a vertical position (as seen in FIG. 3) such that the seat member is parallel to bed frame 26 and perpendicular to desk member 30. Seat member has opposite ends 40 and 42 which are pivotally mounted to opposite ends 44 and 46, respectively, of desk member 30, so pivoting the seat member into its vertical orientation is relatively easy to do. When desk member 30 is in its elevated position, flat surface 48 is held horizontally so that the desk member can act as a desk.

Figure 4:
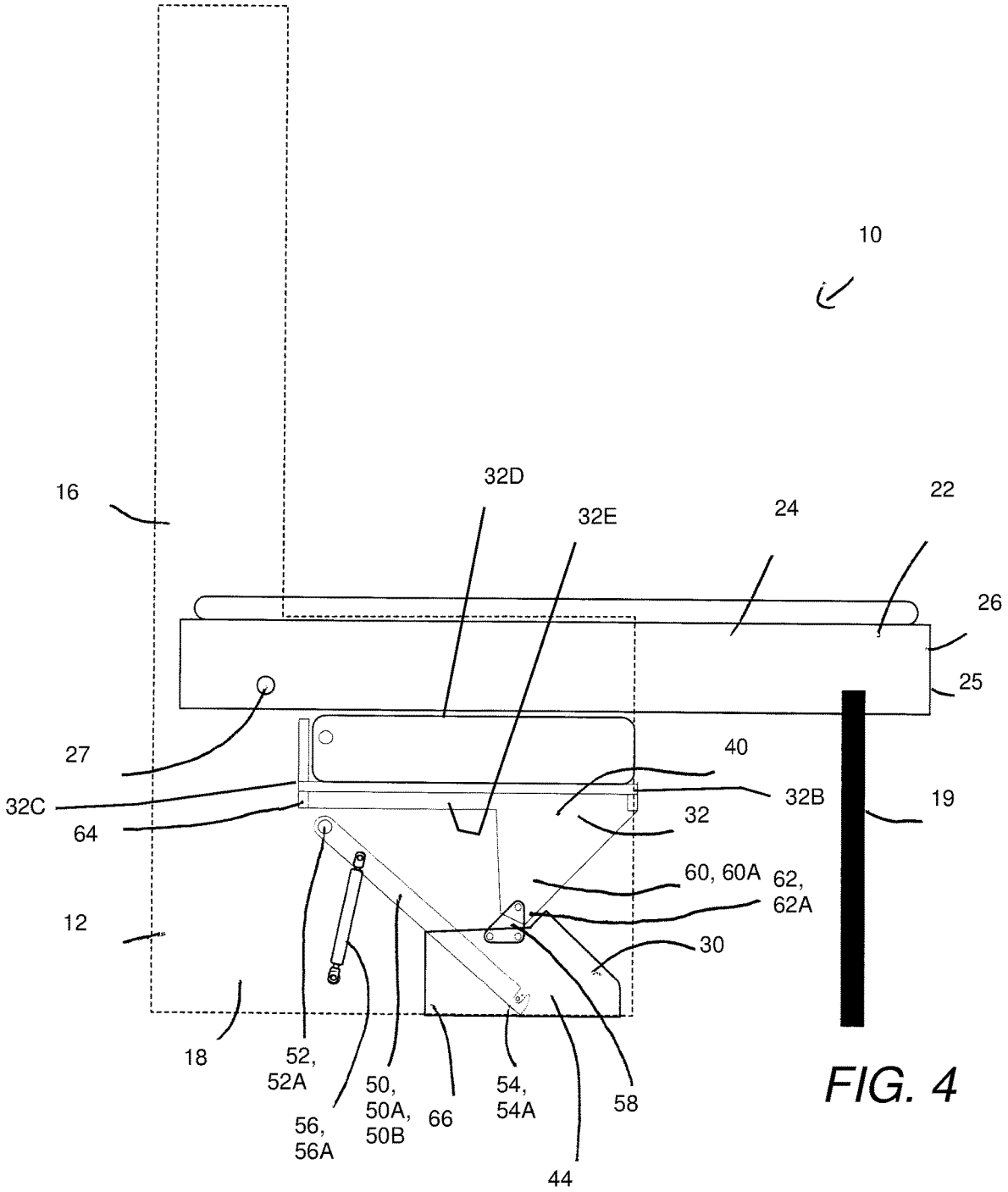
FIG. 4 is a side elevation and sectional view of the furniture shown in FIG. 1 showing the furniture in its bed orientation.

Referring now to FIG. 4, bed frame 22 is pivotally mounted to frame members at pivot point 27 (upper right pivot point 27, upper left pivot point 29). Since only the left side of bed 10 is shown in FIG. 4, we can see that end 24 of bed frame 22 is pivotally connected at point 27 to frame member 12. Support leg 19 may be pivotally connected to bed frame 22 at side 24 to act as a support member to help support the end of bed frame 22 when the bed is in it's bed orientation as shown in FIG. 4. An identical arrangement is found on the right side of bed 10 including the pivot point and the support leg. Desk member 30 is pivotally connected to the frame members by support arms 50 (a right elongated arm 50A pivotally connected to the lower right portion at a lower right pivot point 52 and the first desk end, the lower right pivot point being on a lower right section of the lower right portion orthogonal to the upper right portion; a left elongated arm 50B pivotally connected to the lower left portion at a lower left pivot point 52A and the second desk end, the lower left pivot point being on a lower left section of the lower left portion orthogonal to said upper left portion). Arm 50 is pivotally attached to frame member 12 at point 52 and it is pivotally attached to end 44 of desk member 30 at point 54 (first desk pivot point 54, second desk pivot point 54A). Seat member 32 is pivotally mounted to desk member 30 by pivotal attachment joint 58 such that the seat member is positioned between bed frame 22 and desk member 30. End 40 of seat member 32 has projecting arm 60 with peripheral end 62 (a first projecting arm 60 extending perpendicularly at the first seat end from said bottom seat side toward the elongated desk member and being comprised of a first peripheral end 62; a second projecting arm 60A extending perpendicularly at the second seat end from the bottom seat side toward the elongated desk member and being comprised of a second peripheral end 62A). Peripheral end 62 is pivotally coupled to pivotal attachment joint 58. Projecting arm 60 is dimensioned such that rear end 64 of seat member 32 can be pivoted behind rear end 66 of desk member 30 as shown in FIG. 6.

Figure 5:
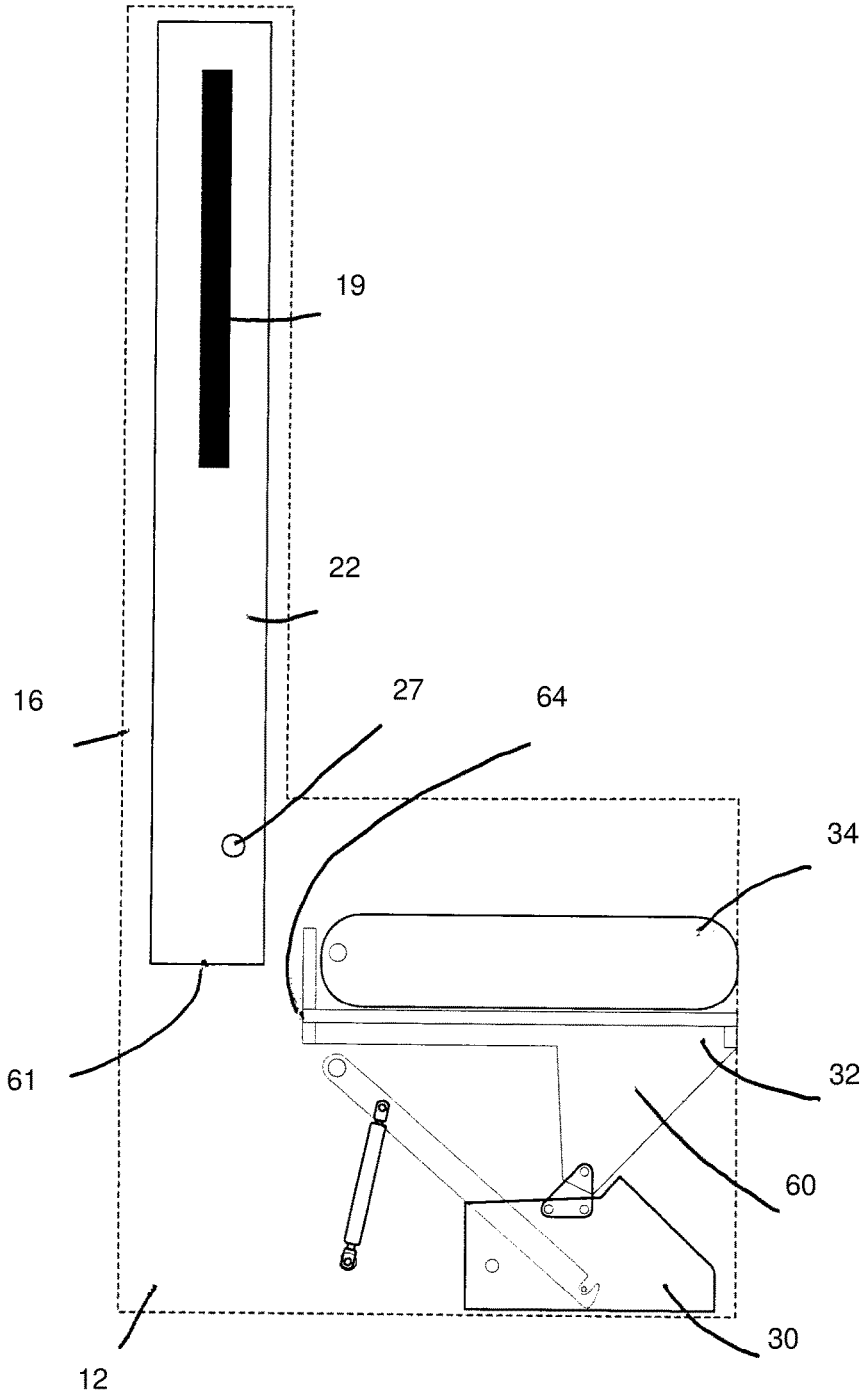
FIG. 5 is a side elevation and sectional view of the furniture shown in FIG. 1 showing the furniture in its sofa orientation.

Referring now to FIG. 5, bed frame 22 can be placed into a vertical orientation as shown wherein the bed frame is preferably nestled between upper portions 16 of the frame members 12. Support leg 19 is folded so that it is parallel with bed frame 22 and tucks in between upper portions 16. Pivot point 27 is positioned such that rear portion 61 of bed frame 22 does not contact rear portion 64 of seat member 32 when the bed frame is in its vertical orientation. In this orientation, seat member 32 is exposed and the user may sit on seat cushion 34 and use transformable bed 10 as a sofa. The weight of seat member 32 and the user sitting on the seat cushion is carried by arm 60 down to desk member 30 which is recumbent on the floor since the desk member is in its lowered orientation.

Figure 6:
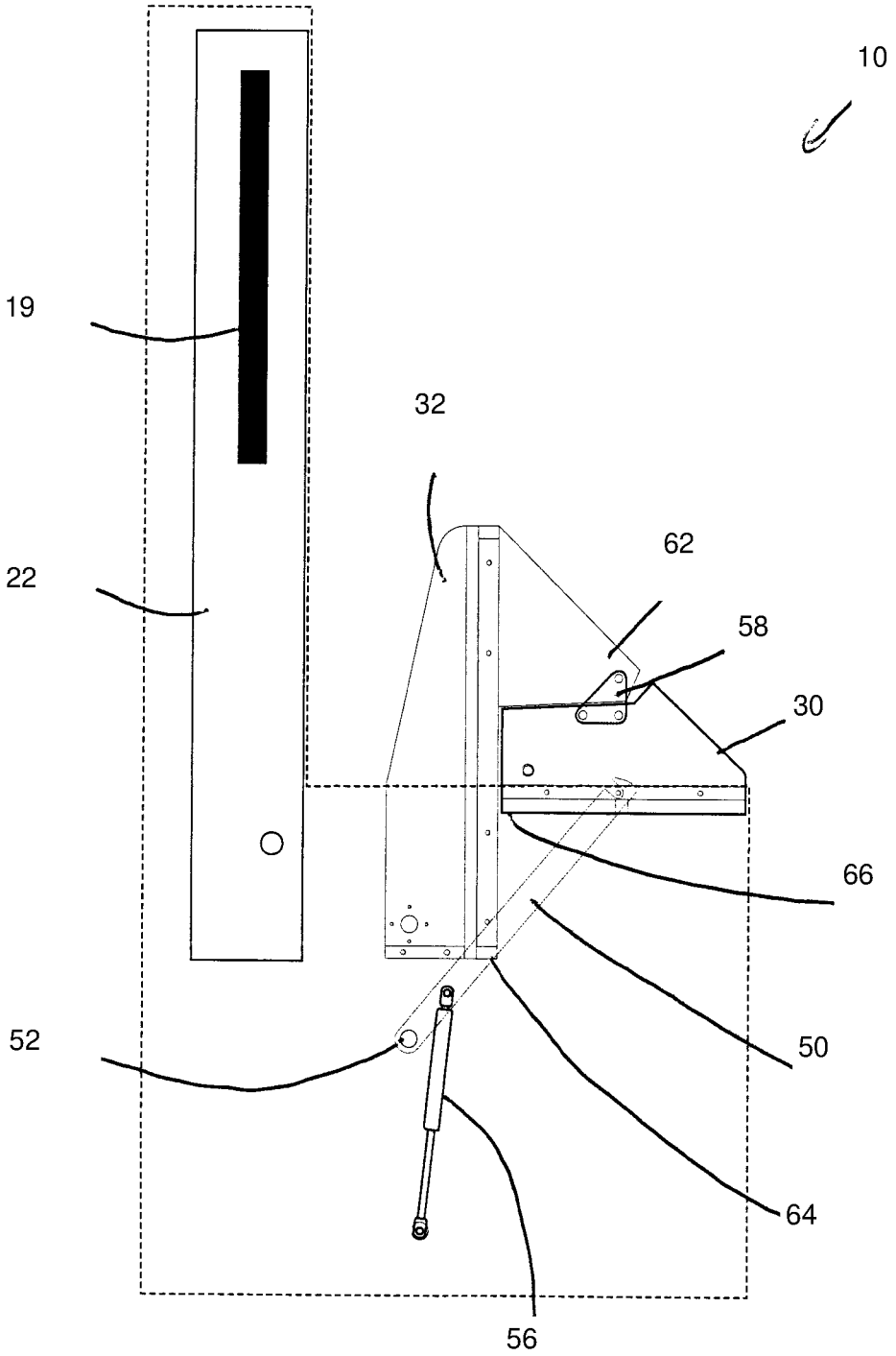
FIG. 6 is a side elevation and sectional view of the furniture shown in FIG. 1 showing the furniture in its desk orientation.

Referring now to FIG. 6, desk member 30 can be placed into its raised orientation by physically raising the desk member by pivoting arm 50 about pivot point 52. Seat member 32 can be pivoted into a vertical orientation as desk member 30 is raised, with the intent of placing seat member 32 into its vertical orientation where it is parallel to bed frame 22 and perpendicular to the desk member. In this orientation, transformable furniture 10 can be used as a desk. Arm 50 is dimensioned such that here is sufficient room under desk member 30 to accommodate a user's legs permitting the user to use the desk member as a desk. Suspension element 56 (a first dampener 56 pivotally connected to the right elongated arm and the lower right section of the lower right portion; a second dampener 56A pivotally connected to the left elongated arm and the lower left section of the lower left portion) preferably comprises a gas spring which is configured to keep desk member 30 in its raised position.

The present invention has many advantages over the prior art. In particular, the invention permits the same piece of furniture to fulfill three separate functions. Also, by effectively including three separate types of furniture into a single item, considerable space can be saved. The net effect is that this single piece of furniture can be used in spaces where space is at a premium such as a small bedroom or a small apartment.

A specific embodiment of the present invention has been disclosed; however, several variations of the disclosed embodiment could be envisioned as within the scope of this invention.

It is to be understood that the present invention is not limited to the embodiments described above, but encompasses any and all embodiments within the scope of the following claims.

I claim:

1. A transformable piece of furniture, comprising:

a housing comprising:

a right L shaped member having an upper right portion 16 and a lower right portion, said lower right portion being set at a right angle to said upper right portion and having a bottom right edge and a top right edge;

a left L-shaped member having an upper left portion and a lower left portion, said lower left portion being set at a right angle to said upper left portion and having a bottom left edge and a top left edge; and a transverse member extending between said upper right portion and said upper left portion;

a bed frame extending between said right L-shaped member and said left L-shaped member and being pivotally coupled to said upper right portion at an upper right pivot point and said upper left portion at an upper left pivot point, respectively, wherein said bed frame has a horizontal orientation adjacent and parallel to said lower right portion and said lower left portion, and wherein said bedframe has a vertical orientation adjacent and parallel to said upper right portion and said upper left portion, said bedframe being pivotally movable at said upper right pivot point and said upper left pivot point between said horizontal orientation and said vertical orientation;

an elongated desk member extending between said right L-shaped member and said left L-shaped member and being comprised of a flat desk surface with a first desk end and a second desk end opposite said first desk end, said first desk end being adjacent said lower right portion, said second desk end being adjacent said lower left portion;

a right elongated arm pivotally connected to said lower right portion at a lower right pivot point and said first desk end at a first desk pivot point, said lower right pivot point being on a lower right section of said lower right portion orthogonal to said upper right portion;

a left elongated arm pivotally connected to said lower left portion at a lower left pivot point and said second desk end at a second desk pivot point, said lower left pivot point being on a lower left section of said lower left portion orthogonal to said upper left portion, wherein said elongated desk member has a lowered position with said first desk end adjacent said bottom right edge and said second desk end adjacent said bottom left edge, wherein said elongated desk member has a raised position with said first desk end adjacent said top right edge, said second desk end adjacent said top left edge and said bed frame in said vertical orientation, said elongated desk member being pivotally movable by said right elongated arm and said left elongated arm between said lowered position and raised position; and an elongated seat member extending between said right L-shaped member and said left L-shaped member and being comprised of a flat seat surface with a first seat end and a second seat end opposite said first seat end, said first seat end being pivotally connected to said first desk, said second seat end being pivotally connected to said second desk end, wherein said elongated seat member has a vertical seat position with said flat seat surface perpendicular to said flat desk surface and said elongated desk member in said raised position, and wherein said elongated seat member has a horizontal seat position with said flat seat surface horizontal, above said flat desk surface, and parallel to said flat desk surface and said elongated desk member in said lowered position, said elongated seat member being pivotally movable between said vertical seat position and said horizontal seat position.

2. The transformable piece of furniture, according to claim 1, wherein said flat seat surface is comprised of a first seat edge, a second seat edges opposite said first seat edge, a top seat side facing upward so as to form a seating surface with said elongated seat member in said horizontal seat position, and a bottom seat side opposite said top seat side.

3. The transformable piece of furniture, according to claim 2, further comprising:

a first projecting arm extending perpendicularly at said first seat end from said bottom seat side toward said elongated desk member and being comprised of a first peripheral end; and a second projecting arm extending perpendicularly at said second seat end from said bottom seat side toward said elongated desk member and being comprised of a second peripheral end, wherein said first peripheral end is pivotally attached to said first desk end, and wherein said second peripheral end is pivotally attached to said second desk end.

4. The transformable piece of furniture, according to claim 1, further comprising:

a first dampener pivotally connected to said right elongated arm and said lower right section of said lower right portion; and a second dampener pivotally connected to said left elongated arm and said lower left section of said lower left portion.

* * * * *